US010847881B2

(12) United States Patent
McGough et al.

(10) Patent No.: US 10,847,881 B2
(45) Date of Patent: Nov. 24, 2020

(54) DUAL-BAND ANTENNA WITH NOTCHED CROSS-POLARIZATION SUPPRESSION

(71) Applicant: PC-TEL, Inc., Bloomingdale, IL (US)

(72) Inventors: Erin McGough, Cuyahoga Falls, OH (US); Scott Lindner, Hudson, OH (US); Thomas Lutman, Berlin Center, OH (US)

(73) Assignee: PC-TEL, INC., Bloomingdale, IL (US)

( * ) Notice: Subject to any disclaimer, the term of this patent is extended or adjusted under 35 U.S.C. 154(b) by 12 days.

(21) Appl. No.: 16/265,449

(22) Filed: Feb. 1, 2019

(65) Prior Publication Data

US 2020/0251822 A1 Aug. 6, 2020

(51) Int. Cl.

| | |
|---|---|
| ***H01Q 5/15*** | (2015.01) |
| ***H01Q 9/26*** | (2006.01) |
| ***H01Q 5/28*** | (2015.01) |
| ***H01Q 1/48*** | (2006.01) |
| ***H01Q 21/30*** | (2006.01) |

(52) U.S. Cl.

CPC ..... *H01Q 5/15* (2015.01); *H01Q 1/48* (2013.01); *H01Q 5/28* (2015.01); *H01Q 9/26* (2013.01)

(58) Field of Classification Search

CPC ..... H01Q 21/30; H01Q 9/26; H01Q 9/0414; H01Q 9/0421; H01Q 9/42; H01Q 5/15; H01Q 5/28; H01Q 5/342; H01Q 5/357; H01Q 5/364; H01Q 5/371

USPC ..... 343/700 MS, 702, 846, 713, 770, 795

See application file for complete search history.

(56) References Cited

U.S. PATENT DOCUMENTS

| | | | | |
|---|---|---|---|---|
| 6,147,648 | A | 11/2000 | Granholm et al. | |
| 6,184,844 | B1 | 2/2001 | Filipovic et al. | |
| 7,304,611 | B2 * | 12/2007 | Yuanzhu | H01Q 9/0421 343/700 MS |
| 2004/0263400 | A1 * | 12/2004 | Yuanzhu | H01Q 9/0442 343/702 |
| 2007/0229385 | A1 | 10/2007 | Deng et al. | |
| 2009/0096700 | A1 | 4/2009 | Chair | |
| 2010/0171675 | A1 | 7/2010 | Borja et al. | |

(Continued)

OTHER PUBLICATIONS

Title:Antenna Device, Date: Mar. 14, 2018, p. 1-7 (Translation), Publisher:JP6341399B1 (Year: 2018).*

(Continued)

*Primary Examiner* — Wei (Victor) Y Chan

(74) *Attorney, Agent, or Firm* — Husch Blackwell LLP

(57) ABSTRACT

A dual-band antenna with notched cross-polarization suppression can include a symmetrical feed tab, a short circuit leg electrically coupled to the symmetrical feed tab, and symmetrical arms electrically coupled to and extending from opposing sides of the short circuit leg. When a signal with a first frequency energizes the symmetrical feed tab, a combination of the symmetrical feed tab and the short circuit leg can form a first radiating section, but when a signal with a second frequency energizes the symmetrical feed tab, the symmetrical arms can form a second radiating section. The symmetrical feed tab and the symmetrical arms can be oriented such that symmetry of the symmetrical feed tab and the symmetrical arms can yield a cumulative cross-polarization distribution derived from radiation from surface currents on the symmetrical feed tab and the symmetrical arms that theoretically vanishes at a plurality of points in an azimuth plane.

20 Claims, 6 Drawing Sheets

(56) References Cited

U.S. PATENT DOCUMENTS

| | | | | |
|---|---|---|---|---|
| 2017/0317417 | A1 | 11/2017 | McGough et al. | |
| 2019/0229426 | A1* | 7/2019 | Kim | H01Q 21/065 |
| 2019/0288399 | A1* | 9/2019 | Tanaka | H01Q 1/48 |

OTHER PUBLICATIONS

Title:Antenna Device, Date: Mar. 14, 2018, p. 1-7, Publisher:JP6341399B1 (Year: 2018).*

Wistron NeWeb Corporation, Product Name: 802.11ax Antenna, Copyright © 1994-2019.

PCT International Search Report from corresponding PCT application PCT/US2020/016225, dated Apr. 24, 2020.

PCT Written Opinion of the International Searching Authority from corresponding PCT application PCT/US2020/016225, dated Apr. 24, 2020.

* cited by examiner farfield (x=2.45) [1]

| | |
|---|---|
| Type: | Farfield |
| Approximation: | enabled (hE = > 1) |
| Component: | Ade |
| Output: | Reinforced Gam |
| Frequency: | 2.45 GHz |
| Red. effic.: | -0.27250 dB |
| Tot. effic.: | -0.1185 dB |
| rtot. Gam: | 1.806 dB |

farfield (x=5.5) [1]

| | |
|---|---|
| Type: | Farfield |
| Approximation: | enabled (hE = > 1) |
| Component: | Ade |
| Output: | Reinforced Gam |
| Frequency: | 1.5 GHz |
| Red. effic.: | -0.04833 dB |
| Tot. effic.: | -0.1031 dB |
| rtot. Gam: | 1.806 dB |

DUAL-BAND ANTENNA WITH NOTCHED CROSS-POLARIZATION SUPPRESSION

FIELD

The present invention relates generally to radio frequency (RF) communication hardware. More particularly, the present invention relates to a dual-band antenna with notched cross-polarization suppression.

BACKGROUND

It is desirable that 802.11ax antenna systems achieve 45 dB of isolation between any two antennas from two different sets of antennas. However, known antenna systems fail to provide such a required level of isolation. For example, the antenna described in U.S. patent application Ser. No. 15/962,064 presents a highly θ-polarized antenna element that comes close to but fails to achieve 45 dB of isolation. Specifically, antenna elements in known antenna systems fail to provide high enough levels of cross-polarization suppression. Furthermore, known θ-polarized antenna elements have a large footprint that limits flexibility in positioning and orienting these antenna elements to optimize the antenna systems, possess unsatisfactory azimuth plane ripple when located in a corner of a large ground plane, and/or are difficult to manufacture.

In view of the above, there is a continuing, ongoing need for improved antennas.

DETAILED DESCRIPTION

Figure 1:
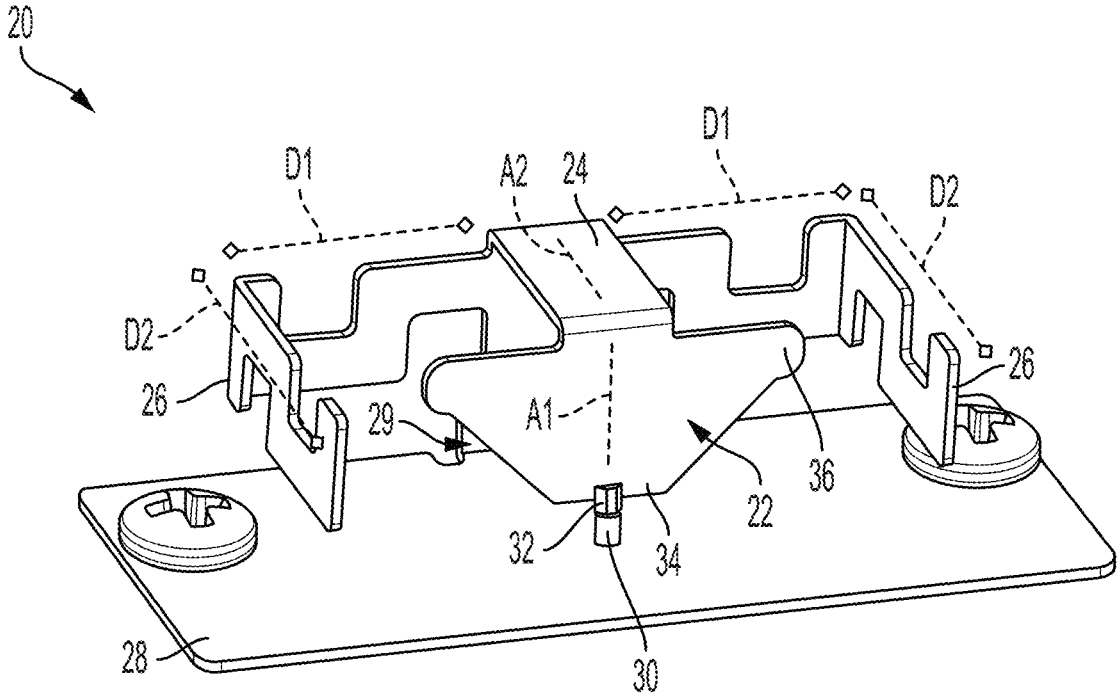
FIG. 1 is a perspective view of a dual-band antenna with notched cross-polarization suppression in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include a dual-band antenna with notched cross-polarization suppression. In some embodiments, the dual-band antenna disclosed herein can achieve at least 45 dB of isolation over a defined spatial region, can have a smaller footprint than antennas known in the art, thereby providing flexibility in positioning and orienting the dual-band antenna relative to other antennas, can possess lower azimuth plane ripple than antennas known in the art when located in a corner of a large ground plane, and, in some embodiments, can be fabricated from a single piece of metal to simplify assembly and reduce cost. In accordance with disclosed embodiments, the isolation of the dual-band antenna may be optimized by appropriately positioning and orienting the dual-band antenna relative to an orthogonally-polarized antenna.

Figure 2:
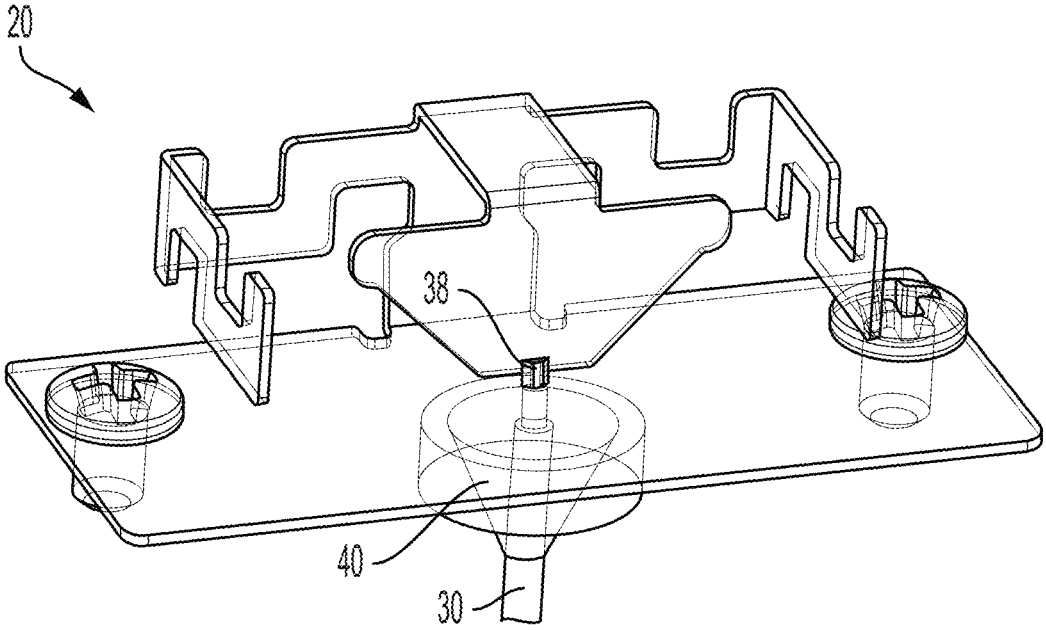
FIG. 2 is a semi-transparent perspective view of a dual-band antenna with notched cross-polarization suppression in accordance with disclosed embodiments.

FIG. 1 is a perspective view of a dual-band antenna 20 in accordance with disclosed embodiments, and FIG. 2 is a semi-transparent perspective view of the dual-band antenna 20 in accordance with disclosed embodiments. As seen in FIG. 1, in some embodiments, the dual-band antenna 20 can include a symmetrical feed tab 22, a short circuit leg 24, and symmetrical arms 26. A first end of the short circuit leg 24 can be electrically coupled to the symmetrical feed tab 22, a second end of the short circuit leg 24 can be electrically coupled to a ground plane 28 at a short circuit point 29, and the symmetrical arms 26 can be electrically coupled to and extend from opposing sides of the short circuit leg 24. In some embodiments, the symmetrical feed tab 22, the short circuit leg 24, the symmetrical arms 26, and the ground plane 28 can exist as a single monolithic structure that can be stamped and formed from a single piece of metal.

As seen in FIG. 1 and FIG. 2, the symmetrical feed tab 22 can be electrically coupled to a center conductor 38 of an RF cable 30 at a feed connection point 32 on a top side of the ground plane 28, and a shield 40 of the RF cable 30 can be coupled to a bottom side of the ground plane 28. The symmetrical feed tab 22 can be symmetrical with respect to a central axis A1 that is aligned with the feed connection point 32, and in some embodiments, the symmetrical feed tab 22 can include a trapezoid shape that tapers from a narrow end 34 adjacent to the feed connection point 32 to a wide end 36 adjacent to the short circuit leg 24.

As seen in FIG. 1, the short circuit leg 24 and the symmetrical arms 26 can be symmetrical with respect to an axis A2 that is perpendicular to the axis A1. In some embodiments, each of the symmetrical arms 26 can include a respective symmetrical meandering structure that can reduce a physical space occupied by the symmetrical arms 26, thereby providing the dual-band antenna 20 with a compact structure and reducing mechanical loading on the short circuit leg 24. In some embodiments, a respective path length of each of the symmetrical arms 26 can be greater than a respective volume length because folds and bends in the respective symmetrical meandering structure of each of the symmetrical arms 26 can reduce the respective volume length of each of the symmetrical arms 26 without changing the respective path length. In this regard, it is to be understood that the respective volume length of each of the symmetrical arms 26 can be measured in a single plane as a distance between a connection point of a respective one of the symmetrical arms 26 with the short circuit leg 24 and a distal end of that one of the symmetrical arms 26. In some embodiments, each of the symmetrical arms 26 can be bent to form a respective L-shape to further provide the dual-band antenna 20 with the compact structure, and in these embodiments, the respective volume length of each of the symmetrical arms 26 can be a sum of a distance D1 (e.g. a distance between the connection point of a respective one of the symmetrical arms 26 with the short circuit leg 24 and a bend in the respective L-shape of that one of the symmetrical arms 26) and a distance D2 (e.g. a distance between the bend in the respective L-shape of that one of the symmetrical arms 26 and the distal end of that one of the symmetrical arms 26). It is also to be understood that the respective path length of each of the symmetrical arms 26 can be defined by a path that an electron moving within a metal structure of a respective one of the symmetrical arms 26 follows, which, in the example of FIG. 1, includes both horizontal portions and vertical portions of that one of the symmetrical arms 26.

In operation, the RF cable 30 can energize the dual-band antenna 20 with signals at the symmetrical feed tab 22, and physical characteristics of the symmetrical feed tab 22, the short circuit leg 24, and the symmetrical arms 26 defined during design and manufacture of the dual-band antenna 20 can induce the dual-band antenna 20 to perform in specific, predictable ways in response to the signals. For example, when the symmetrical feed tab 22 is energized by the signals at a first frequency, a combination of the symmetrical feed tab 22 and the short circuit leg 24 can form a first radiating section operating as a monopole antenna. However, when the symmetrical feed tab 22 is energized by the signals at a second frequency, the symmetrical arms 26 can form a second radiating section.

In some embodiments, the physical characteristics of the symmetrical feed tab 22, the short circuit leg 24, and the symmetrical arms 26 can be defined during design and manufacture of the dual-band antenna 20 to tune the first frequency at which the combination of the symmetrical feed tab 22 and the short circuit leg 24 form the first radiating section operating as the monopole antenna and to tune the second frequency at which the symmetrical arms 26 form the second radiating section. In some embodiments, the physical characteristics of the symmetrical feed tab 22, the short circuit leg 24, and the symmetrical arms 26 can be tuned so that the first frequency is a high band frequency and so that the second frequency is a low band frequency, and in such embodiments, the high band frequency can be approximately 5.5 GHz, and the low band frequency can be approximately 2.45 GHz.

The physical characteristics of the symmetrical feed tab 22, the short circuit leg 24, and the symmetrical arms 26 that can be altered to tune the first frequency and the second frequency can include a degree of taper from the narrow end 34 of the symmetrical feed tab 22 to the wide end 36 of the symmetrical feed tab 22, a respective height of each of the symmetrical arms 26 above the ground plane 28, a respective electrical length of each of the symmetrical arms 26, and an electrical length of the short circuit leg 24. For example, the degree of taper of the symmetrical feed tab 22 can be adjusted to tune the first frequency that causes the combination of the symmetrical feed tab 22 and the short circuit leg 24 to form the first radiating section operating as the monopole antenna. In particular, increasing the degree of taper to lengthen an electrical path from the feed connection point 32 to the short circuit point 29 can decrease the first frequency at which the combination of the symmetrical feed tab 22 and the short circuit leg 24 form the first radiating section operating as the monopole antenna. Furthermore, the respective height of each of the symmetrical arms 26 above the ground plane and the respective electrical length of each of the symmetrical arms 26 can be adjusted to tune the second frequency that causes the symmetrical arms 26 to form the second radiating section. That is, each of the symmetrical arms can include the respective symmetrical meandering structure of resonant length at the second frequency. In particular, increasing the respective electrical length of each of the symmetrical arms 26 can decrease the second frequency at which the symmetrical arms 26 form the second radiating section.

In some embodiments, the respective electrical length of each of the symmetrical arms 26 can be approximately one half of a wavelength of the first frequency, thereby divorcing current to the short circuit leg 24 when the dual-band antenna 20 is operating at the first frequency. Furthermore, in some embodiments, the electrical length of the short circuit leg 24 can be approximately one quarter of the wavelength of the first frequency, thereby providing an open circuit condition at an end of the first radiating section operating as the monopole antenna when the dual-band antenna 20 is operating at the first frequency. Such physical characteristics, as well as an electrical length from the feed connection point 32 to the short circuit point 29, can ensure that radiation from surface currents on the symmetrical feed tab 22 operating as the monopole antenna and on the short circuit leg 24 are nearly in phase so as to source omnidirectional radiation in the H-plane.

Figure 3:
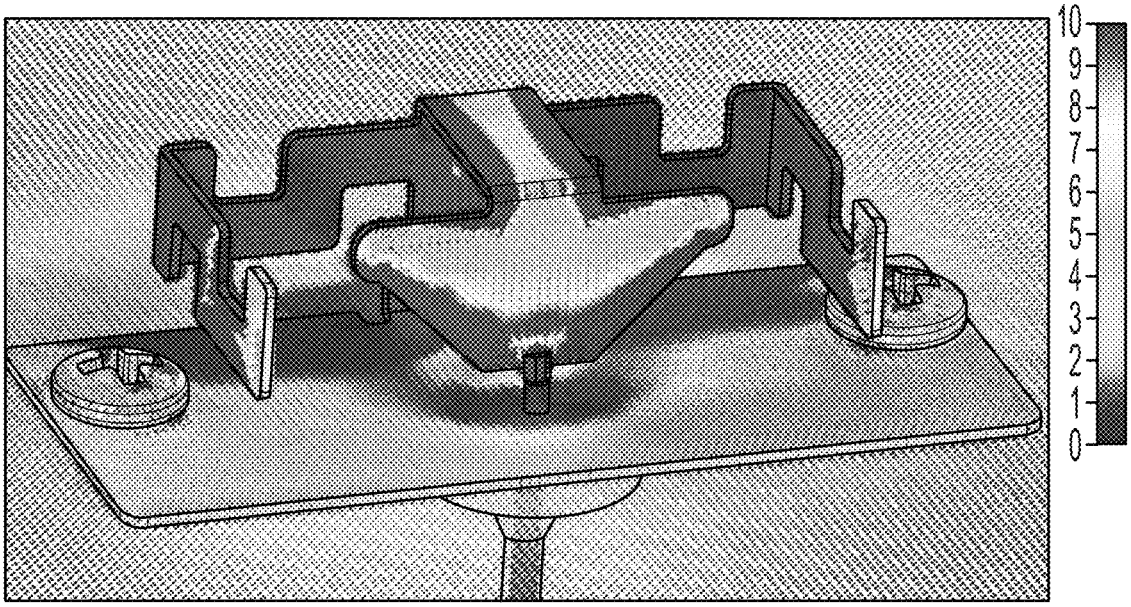
FIG. 3 is a graph of surface current distribution of a dual-band antenna with notched cross-polarization suppression in accordance with disclosed embodiments operating at 2.45 GHz.
Figure 4:
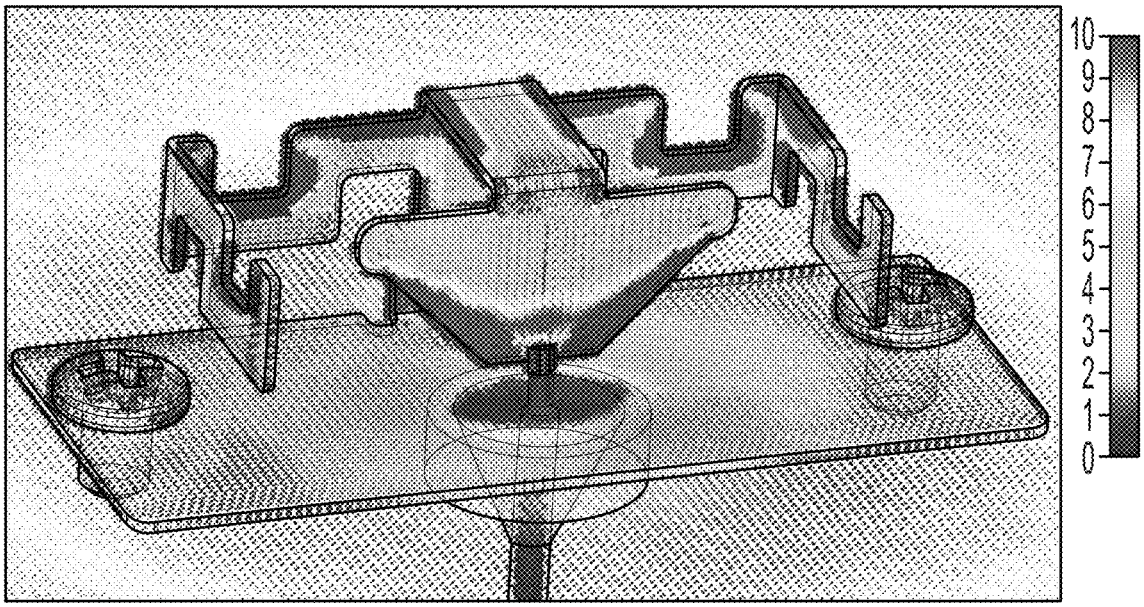
FIG. 4 is a graph of surface current distribution of a dual-band antenna with notched cross-polarization suppression in accordance with disclosed embodiments operating at 5.5 GHz.

In this regard, FIG. 3 is a graph of surface current distribution of the dual-band antenna 20 in accordance with disclosed embodiments operating at 2.45 GHz, and FIG. 4 is a graph of the surface current distribution of the dual-band antenna 20 in accordance with disclosed embodiments operating at 5.5 GHz. As seen in FIG. 3 and FIG. 4, when the symmetrical feed tab 22 is energized by a sinewave at 5.5 GHz, such excitation can be mostly contained to the symmetrical feed tab 22, that is, the monopole antenna, such that first surface currents on the symmetrical feed tab 22 can source much of the radiation. However, when the symmetrical tab 22 is energized by a sinewave at 2.45 GHz, such excitation can be mostly contained to the symmetrical arms 26 such that second surface currents on the symmetrical arms 26 can source much of the radiation.

In some embodiments, the symmetrical feed tab 22 and the symmetrical arms 26 can be designed such that symmetry of the symmetrical feed tab 22 and the symmetrical arms 26 can yield a cumulative cross-polarization distribution derived from the radiation from the first surface currents and the second surface currents that theoretically vanishes at some number of points in an azimuth plane. For example, the symmetry of the symmetrical feed tab 22 and the symmetrical arms 26 can ensure that substantially all of the radiation due to the surface currents in the x direction of a plane perpendicular to the ground plane 28 (e.g. the y-z plane) cancel out, and such cancellation can occur independently of an operating frequency of the signals energizing the symmetrical feed tab 22.

Figure 5:
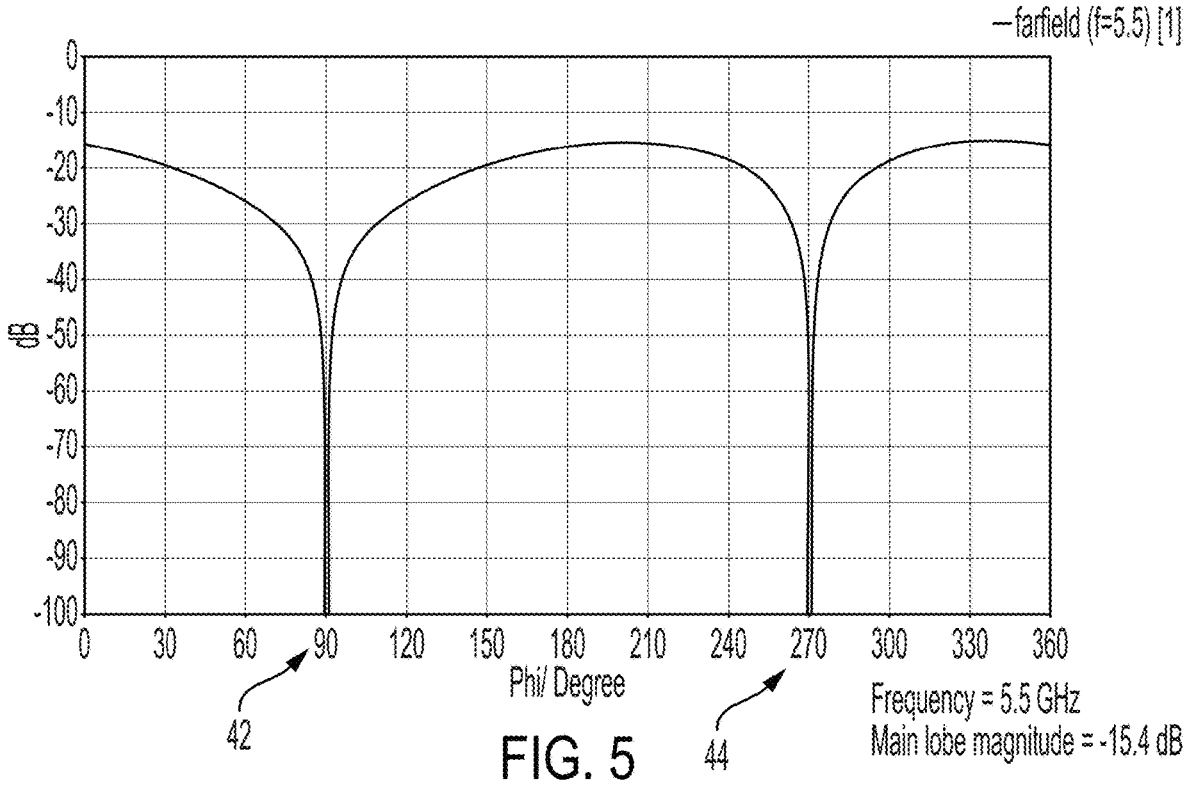
FIG. 5 is a graph of cross-polarization in the azimuth plane of a dual-band antenna with notched cross-polarization suppression in accordance with disclosed embodiments operating at 5.5 GHz.
Figure 6:
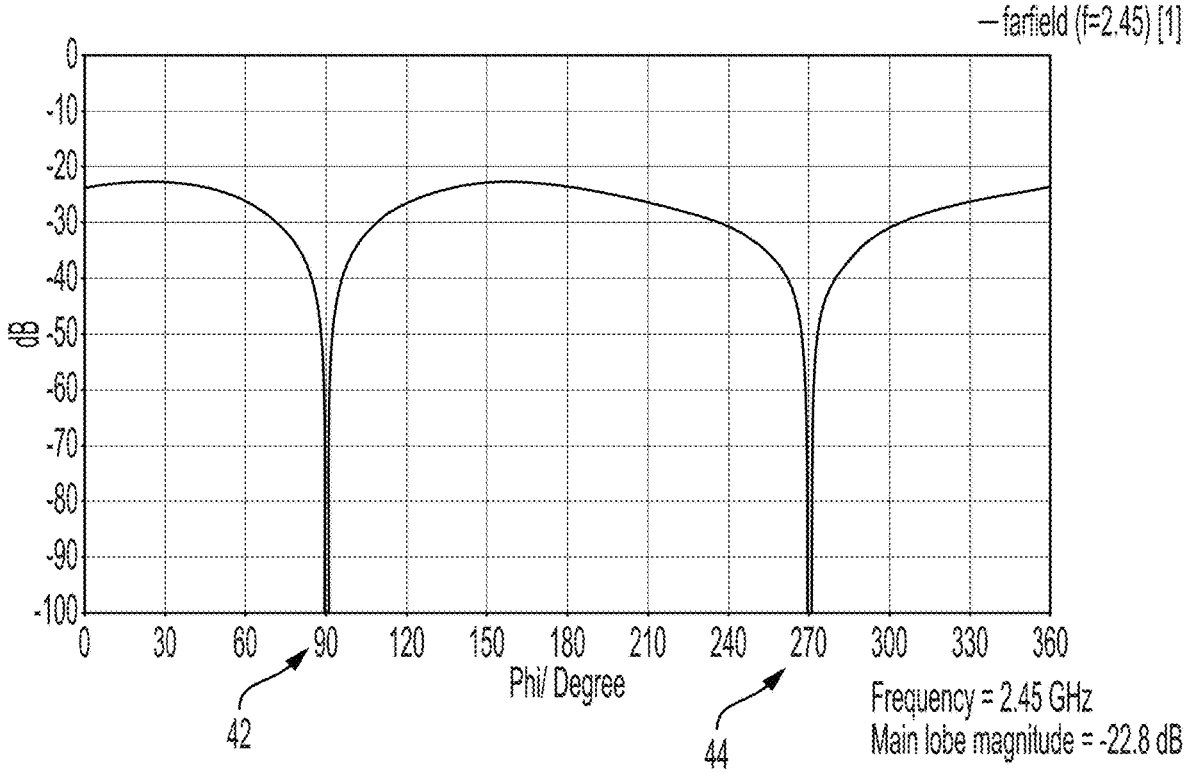
FIG. 6 is a graph of cross-polarization in the azimuth plane of a dual-band antenna with notched cross-polarization suppression in accordance with disclosed embodiments operating at 2.45 GHz.

In this regard, FIG. 5 is a graph of a simulated φ-polarization (cross-polarization) in the azimuth plane of the dual-band antenna 20 in accordance with disclosed embodiments operating at 5.5 GHz in the azimuth plane, and FIG. 6 is a graph of the simulated φ-polarization (cross-polarization) in the azimuth plane of the dual-band antenna 20 in accordance with disclosed embodiments operating at 2.45 GHz in the azimuth plane. Because all radiated contributions due to x-projected surface currents on the symmetrical feed tab 22, the short circuit leg 24, and the symmetrical arms 26 cancel in the y-z plane, the φ-polarization theoretically vanishes there, regardless of carrier frequency. Accordingly, as seen in FIG. 5 and FIG. 6, the φ-polarization theoretically vanishes at azimuth angles at points 42, 44 in the y-z plane. Indeed, such φ-polarization suppression can resemble a notch filter response in the azimuth plane. However, because of the symmetry of the dual-band antenna 20, the notch filter response can exists for all frequencies and not just the first and second frequencies. In some embodiments, the points 42, 44 can be separated by 180° in the azimuth plane and can correspond to the azimuth angles of 90° and 270°. In some embodiments, the point 42 can represent a side of the dual-band antenna 20 with the short circuit leg 24, and the point 44 can represent a side of the dual-band antenna 20 with the symmetrical feed tab 22.

As seen in FIG. 5 and FIG. 6, suppression windows around the points 42, 44 can be at least 37° wide in which the φ-polarization is at most −30 dBi. However, in some embodiments, one of the suppression windows created by the notch filter response around the point 42 can be wider than another one of the suppression windows created by the notch filter response around the point 44. Accordingly, the dual-band antenna 20 may be oriented so that the side with the short circuit leg 24 points to a strongly φ-polarized antenna to achieve excellent decoupling of greater than 45 dB at 1λ spacing.

Figure 7:
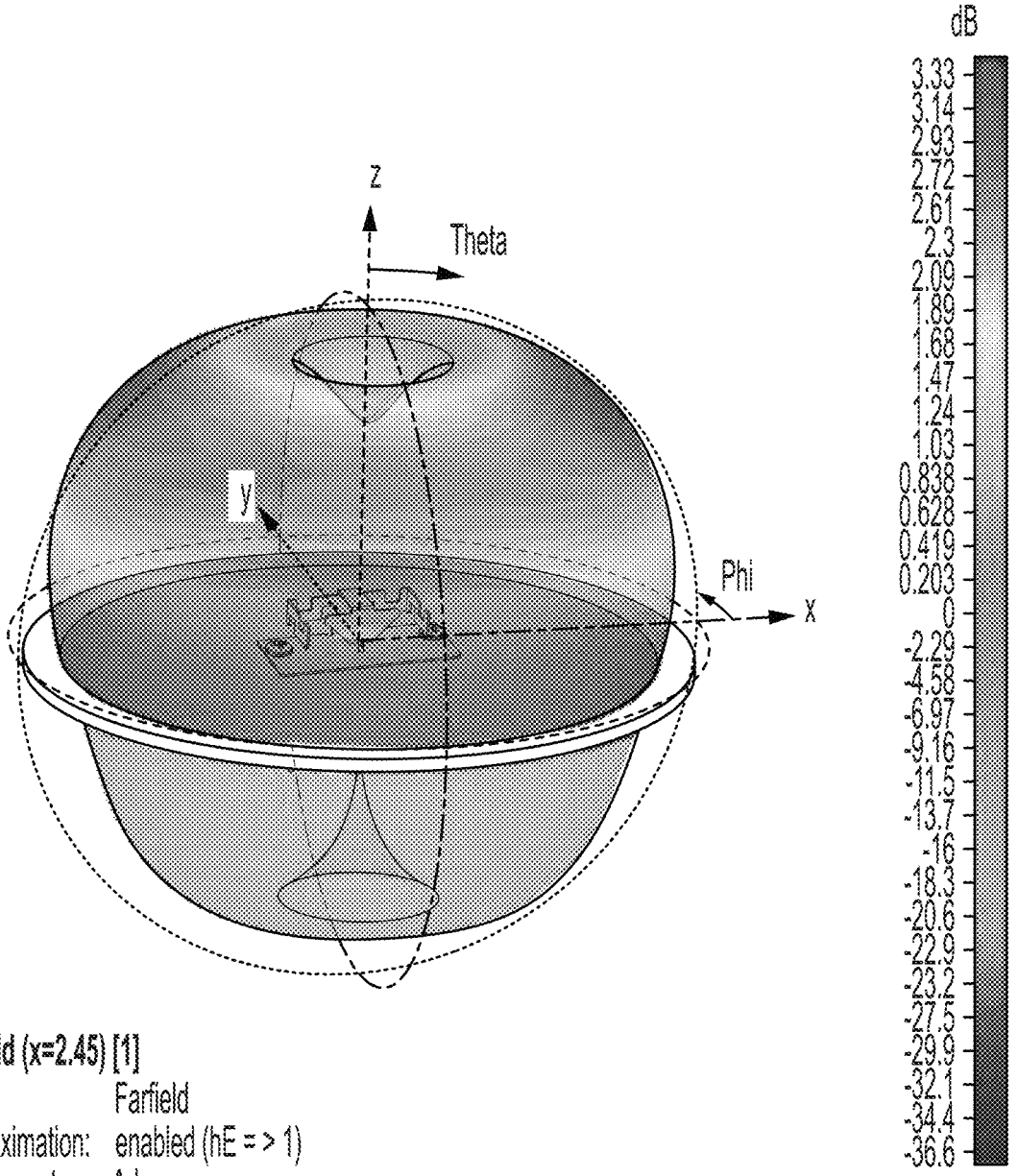
FIG. 7 is a graph of a 3D radiation pattern of a dual-band antenna with notched cross-polarization suppression in accordance with disclosed embodiments operating at 2.45 GHz.
Figure 8:
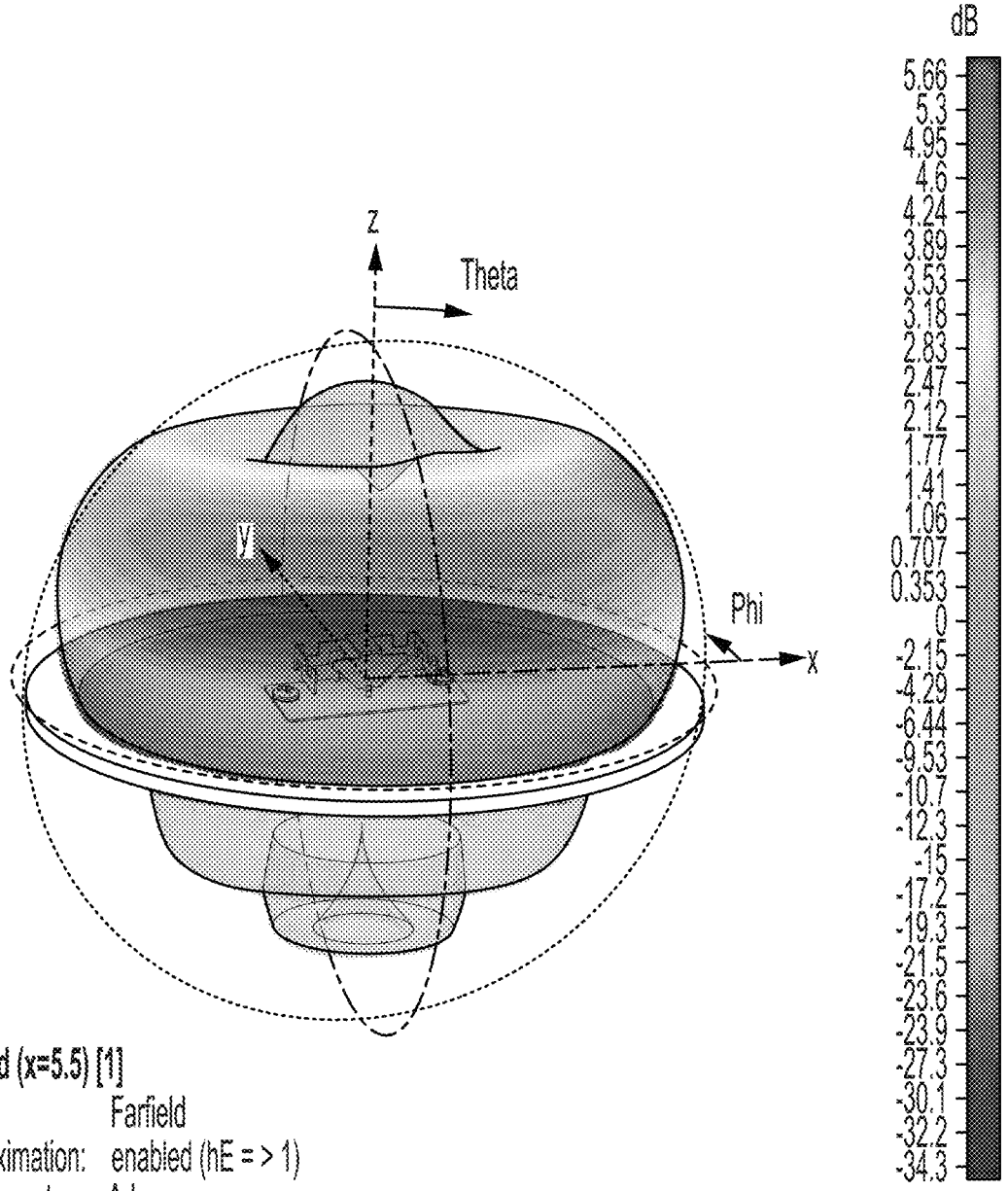
FIG. 8 is a graph of a 3D radiation pattern of a dual-band antenna with notched cross-polarization suppression in accordance with disclosed embodiments operating at 5.5 GHz.
Figure 9:
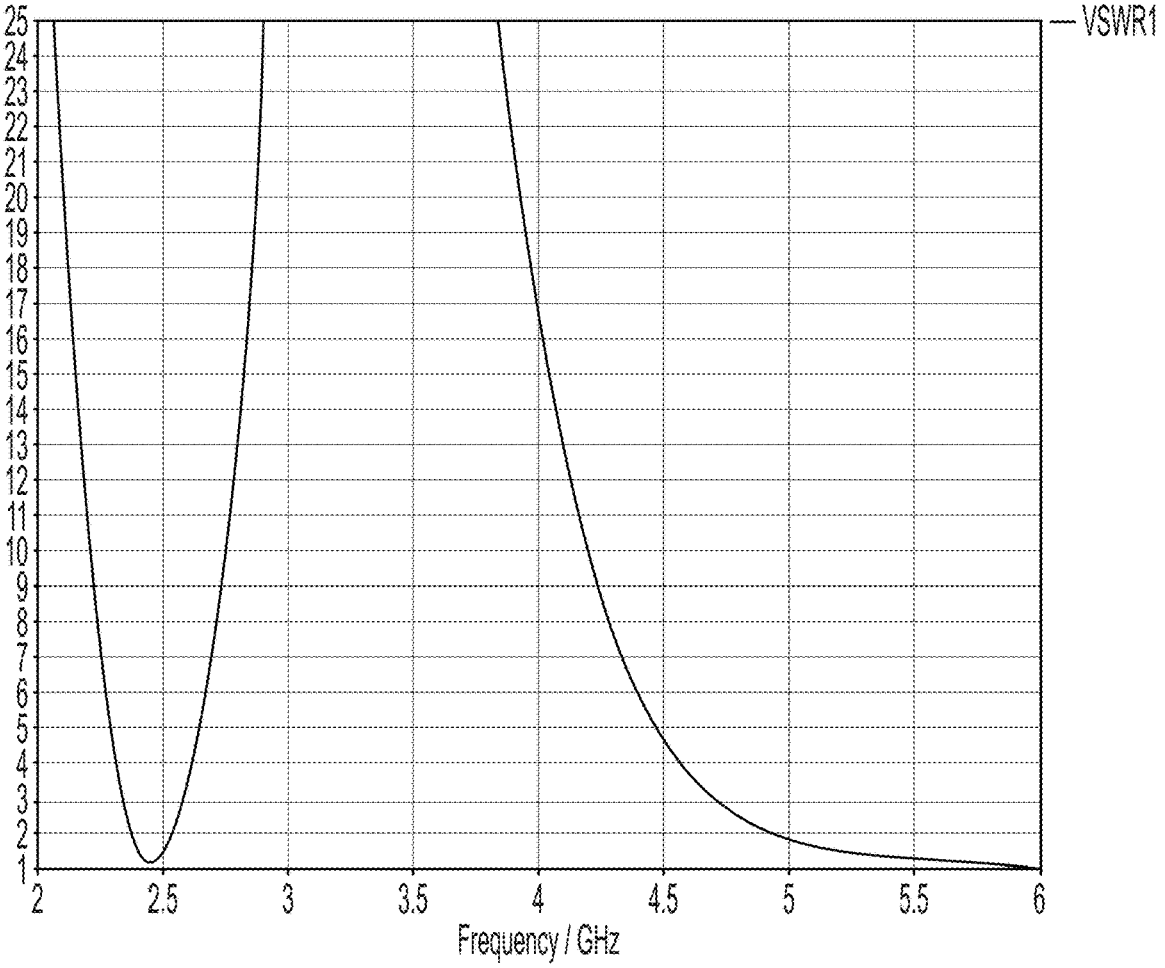
FIG. 9 is a graph of a simulated voltage standing wave ratio of a dual-band antenna with notched cross-polarization suppression in accordance with disclosed embodiments.
Figure 10:
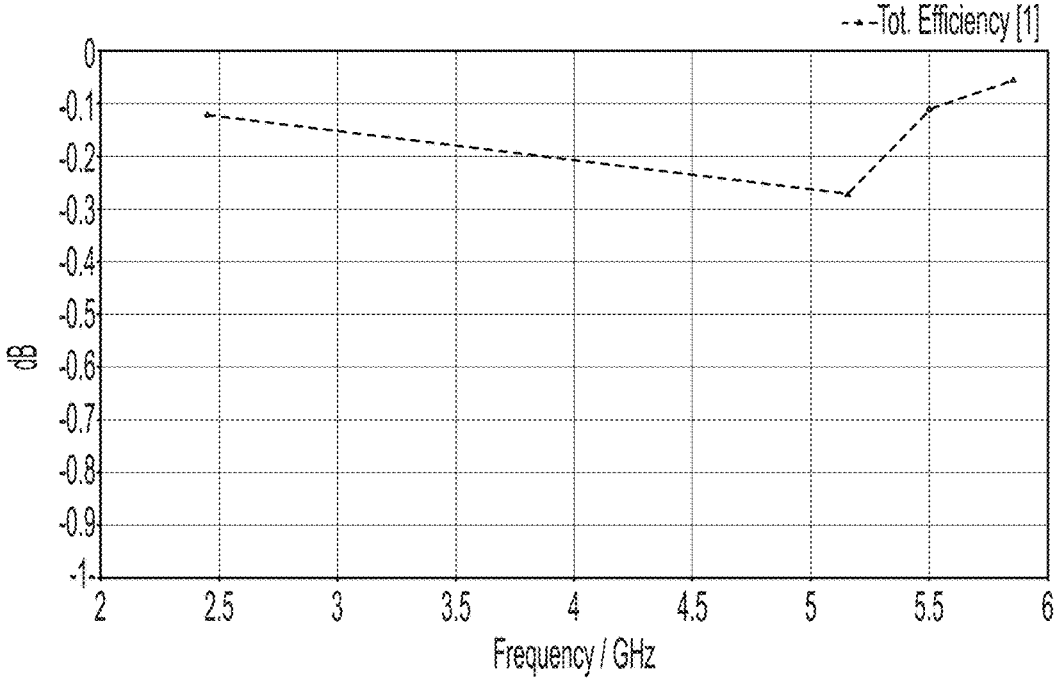
FIG. 10 is a graph of simulated efficiency of a dual-band antenna with notched cross-polarization suppression in accordance with disclosed embodiments.

In accordance with the above, FIG. 7 is a graph of a 3D radiation pattern of the dual-band antenna 20 in accordance with disclosed embodiments operating at 2.45 GHz, FIG. 8 is a graph of a 3D radiation pattern of the dual-band antenna 20 in accordance with disclosed embodiments operating at 5.5 GHz, FIG. 9 is a graph of a simulated voltage standing wave ratio of the dual-band antenna 20 in accordance with disclosed embodiments, and FIG. 10 is a graph of simulated efficiency of the dual-band antenna 20 in accordance with disclosed embodiments.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A dual-band antenna comprising:

a symmetrical feed tab;

a short circuit leg electrically coupled to the symmetrical feed tab; and symmetrical arms electrically coupled to and extending from opposing sides of the short circuit leg;

wherein, when the symmetrical feed tab is energized by a first signal having a first frequency in a first frequency band, a combination of the symmetrical feed tab and the short circuit leg form a first radiating section, wherein, when the symmetrical feed tab is energized by a second signal having a second frequency in a second frequency band, the symmetrical arms form a second radiating section, wherein the first signal induces first surface currents on the symmetrical teed tab, wherein the second signal induces second surface currents on the symmetrical arms, and wherein the symmetrical feed tab and the symmetrical arms are oriented such that symmetry of the symmetrical feed tab and the symmetrical arms yields a cumulative cross-polarization distribution derived from radiation from the first surface currents and the second surface currents that theoretically vanishes at a plurality of points in an azimuth plane.

2. The dual-band antenna of claim 1 wherein a first of the plurality of points is separated by approximately 180° in the azimuth plane from a second of the plurality of points.

3. The dual-band antenna of claim 1 further comprising:

a ground plane electrically coupled to the short circuit leg at a short circuit point.

4. The dual-band antenna of claim 3 wherein the symmetrical feed tab, the short circuit leg, the symmetrical arms, and the ground plane exist as a single monolithic structure.

5. The dual-band antenna of claim 3 wherein the symmetrical feed tab tapers from a narrow end adjacent to a feed connection point to a wide end adjacent to the short circuit leg, wherein increasing a degree of taper from the narrow end to the wide end decreases the first frequency at which the combination of the symmetrical feed tab and the short circuit leg form the first radiating section, and wherein increasing a respective electrical length of each of the symmetrical arms decreases the second frequency at which the symmetrical arms form the second radiating section.

6. The dual-band antenna of claim 1 wherein the first frequency is a high band frequency and the second frequency is a low band frequency.

7. The dual-band antenna of claim 1 wherein a respective first electrical length of each of the symmetrical arms is approximately one half of a wavelength of the first frequency, and wherein a second electrical length of the short circuit leg is approximately one quarter of the wavelength of the first frequency.

8. The dual-band antenna of claim 7 wherein each of the symmetrical arms includes a respective symmetrical meandering structure of resonant length at the second frequency.

9. A method comprising:

energizing a symmetrical feed tab of a dual-band antenna with a first signal having a first frequency in a first frequency band;

when the symmetrical feed tab is energized with the first signal, a combination of the symmetrical feed tab and a short circuit leg of the dual-band antenna forming a first radiating section;

energizing the symmetrical feed tab with a second signal having a second frequency in a second frequency band;

when the symmetrical feed tab is energized with the second signal, symmetrical arms of the dual-band antenna forming a second radiating section;

the first signal inducing first surface currents on the symmetrical feed tab;

the second signal inducing second surface currents on the symmetrical arms; and a combination of an orientation of the symmetrical feed tab and the symmetrical arms and symmetry of the symmetrical feed tab and the symmetrical arms yielding a cumulative cross-polarization distribution derived from radiation from the first surface currents and the second surface currents that theoretically vanishes at a plurality of points in an azimuth plane.

10. The method of claim 9 wherein a first of the plurality of points is separated by approximately 180° in the azimuth plane from a second of the plurality of points.

11. The method of claim 9 wherein the dual-band antenna includes a ground plane electrically coupled to the short circuit leg at a short circuit point.

12. The method of claim 11 wherein the symmetrical feed tab, the short circuit leg, the symmetrical arms, and the ground plane exist as a single monolithic structure.

13. The method of claim 11 further comprising:

varying a degree of taper from a narrow end of the symmetrical feed tab adjacent to a feed connection point to a wide end of the symmetrical feed tab adjacent to the short circuit leg to tune the first frequency at which the combination of the symmetrical feed tab and the short circuit leg form the first radiating section; and varying a respective height of each of the symmetrical arms above the ground plane and a respective electrical length of each of the symmetrical arms to tune the second frequency at which the symmetrical arms form the second radiating section.

14. The method of claim 9 wherein the first frequency is a high band frequency and the second frequency is a low band frequency.

15. The method of claim 9 wherein a respective first electrical length of each of the symmetrical arms is approximately one half of a wavelength of the first frequency, and wherein a second electrical length of the short circuit leg is approximately one quarter of the wavelength of the first frequency.

16. The method of claim 15 wherein each of the symmetrical arms includes a respective symmetrical meandering structure of resonant length at the second frequency.

17. A method for manufacturing a dual-band antenna comprising:

stamping and forming a single piece of metal into a single monolithic structure that includes a symmetrical feed tab, a short circuit leg electrically coupled to the symmetrical feed tab, symmetrical arms electrically coupled to and extending from opposing sides of the short circuit leg, and a ground plane electrically coupled to the short circuit leg at a short circuit point;

orienting the symmetrical feed tab and the symmetrical arms such that symmetry of the symmetrical feed tab and the symmetrical arms yields a cumulative cross-polarization distribution that theoretically vanishes at a plurality of points in an azimuth plane;

varying a degree of taper from a narrow end of the symmetrical feed tab adjacent to a feed connection point to a wide end of the symmetrical feed tab adjacent to the short circuit leg to tune a first frequency in a first frequency band at which a combination of the symmetrical feed tab and the short circuit leg form a first radiating section; and varying a respective height of each of the symmetrical arms above the ground plane and a respective electrical length of each of the symmetrical arms to tune a second frequency in a second frequency band at which the symmetrical arms form a second radiating section.

18. The method for manufacturing the dual-band antenna of claim 17 further comprising:

stamping and forming each of the symmetrical arms to include a respective first electrical length that is approximately one half of a wavelength of the first frequency; and stamping and forming the short circuit leg to include a second electrical length that is approximately one quarter of the wavelength of the first frequency.

19. The method for manufacturing the dual-band antenna of claim 18 further comprising:

stamping and forming each of the symmetrical arms to include a respective symmetrical meandering structure of resonant length at the second frequency.

20. The dual-band antenna of claim 1 wherein, when the symmetrical feed tab is energized by the first signal, the combination of the symmetrical feed tab and the short circuit leg operate as a monopole antenna.

* * * * *